United States Patent [19]

Noordhof

[11] 3,964,538

[45] June 22, 1976

[54] CORE BOX MOUNTING PLATES IN A SHELL CORE MACHINE

[75] Inventor: Harry Noordhof, Grand Haven, Mich.

[73] Assignee: Lucille E. Noordhof, Grand Haven, Mich.

[22] Filed: May 22, 1975

[21] Appl. No.: 579,954

[52] U.S. Cl. ..... 164/228; 164/234; 164/410; 164/412

[51] Int. Cl.[2] ..... B22C 7/06; B22C 13/12

[58] Field of Search ..... 164/165, 166, 186, 234, 164/410, 412, 228, 353; 249/141

[56] References Cited

UNITED STATES PATENTS

| | | | |
|---|---|---|---|
| 237,634 | 2/1881 | Sneider | 164/410 X |
| 432,122 | 7/1890 | Donaldson | 249/141 X |
| 618,447 | 1/1899 | Suppes | 164/412 UX |
| 1,680,892 | 8/1928 | Low | 249/141 |
| 1,727,565 | 9/1929 | Schall | 164/353 |
| 2,789,326 | 4/1957 | Krauss | 164/234 |
| 3,066,363 | 12/1962 | Jay | 164/234 |
| 3,529,656 | 9/1970 | Levy | 164/234 |
| 3,737,266 | 6/1973 | Yamamoto | 249/141 |

*Primary Examiner*—Ronald J. Shore
*Attorney, Agent, or Firm*—Price, Heneveld, Huizenga & Cooper

[57] ABSTRACT

A pair of generally rectangular core box mounting plates are cast from aluminum. Each plate includes a plurality of parallel spaced ribs extending outwardly from a surface of the plate to define channels therebetween permitting excape of compressed air and sand from core boxes positioned between a pair of such plates. Extending along and sealing one edge of the channels is a ridge which directs the sand, air and gases from the core box to the open ends of the channels. Mounting flanges are provided such that the structure consisting of the core box mounted to the plates can in turn be secured to a shell core machine. In order to accommodate relatively small core boxes, a plurality of the ribs are shortened to provide lands which can accommodate spacer blocks so that a pair of universal plates can be used for different sized core boxes.

10 Claims, 3 Drawing Figures

CORE BOX MOUNTING PLATES IN A SHELL CORE MACHINE

BACKGROUND OF THE INVENTION

The present invention relates to core box mounting plates.

In the art of molding sand cores for foundry use, core boxes are employed which include core mold cavities and vents communicating with the cavities for permitting escape of the air and gases from the sand as it is molded as well as some particulate material. The core boxes have been mounted to flat steel plates which are secured to a shell core machine for heating.

The existent mounting plates thus have flat surfaces which interface with the core boxes. The core boxes themselves have included small semicircular recesses formed in the faces abutting the core box mounting plates for permitting the escape of air for injecting the sand into the mold, gas and some particulate material from the mold cavity and sandwich structure. With such construction, frequently the relatively small semicircular recesses provided for the escape of gas have become clogged with particulate material as have the core box vents, thereby preventing the escape of the gas and air and leading to imperfections in the molded core. As a result, the use of such prior art structure requires frequent removal of the core boxes from the plates for removal of clogging material.

SUMMARY OF THE INVENTION

In order to overcome the difficulties of such prior art, the core box mounting structure of the present invention includes a pair of mounting plates each of which includes a plurality of spaced ribs extending outwardly from a surface of the mounting plate and spaced such that vents from the core box can be aligned with the channels defined by the space between the ribs. Thus, relatively large channels are provided which are not easily clogged, which permit exhaust of air and gases and particulate material, and thus, the core box vents are also less likely to clog. The plates are made of a relatively high conductivity material such that heat is efficiently transferred to a core box sandwiched between two such mounting plates during the molding process.

In the preferred embodiment, the ribs are parallel and terminate in a ridge extending along one edge of the plate for directing the air and gases and any escaping particulate material outwardly from the open end of the channels. Mounting flanges are provided for attaching the structure so defined to a shell core machine. In addition, by providing a few shortened ribs alternately spaced along the mounting plate, spacer blocks can be employed such that a universal mounting plate can be utilized for a plurality of different core box sizes.

With such structure, relatively large channels are provided for venting gas and air and permitting the ready escape of particulate material without clogging the core box vents. Thus, superior quality molded cores can be made using plates embodying the present invention without frequent maintenance. These and other features, advantages and objects of the present invention can best be understood by referring to the following description thereof together with the drawings in which:

DETAILED DESCRIPTION OF THE PREFERRED EMBODIMENT

Referring now to the figures, there is shown a lower core box mounting plate 10 and an upper core box mounting plate 20. To each of these plates there is mounted by suitable bolts (not shown) a core box half. Box halves 30 and 40 are associated with plates 10 and 20 respectively. Inasmuch as the upper and lower mounting plates are identical and the core box halves symmetrical, only the lower mounting plate and core box half is described in detail.

Figure 2:
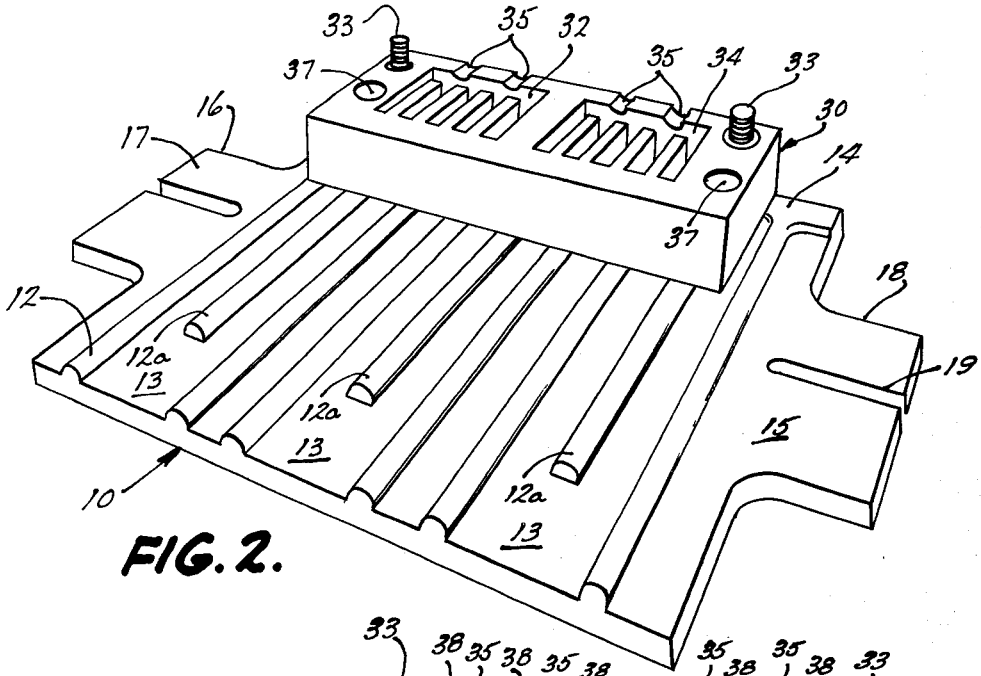
FIG. 2 is a perspective view of the lower half of the core box and mounting plate structure shown in FIG. 1.
Figure 3:
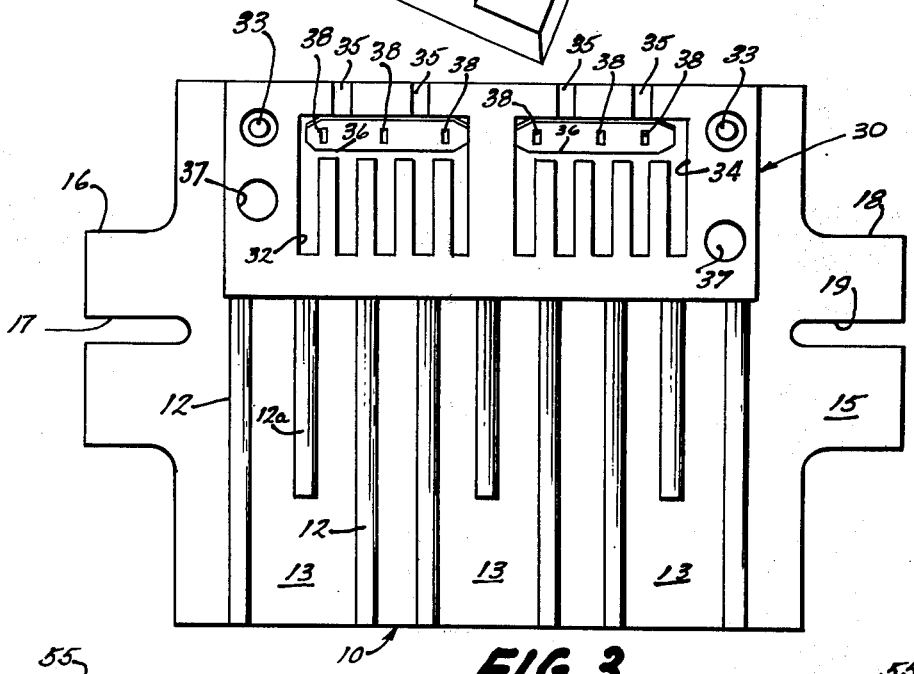
FIG. 3 is a top plan view of the structure shown in FIG. 2.
Figure 1:
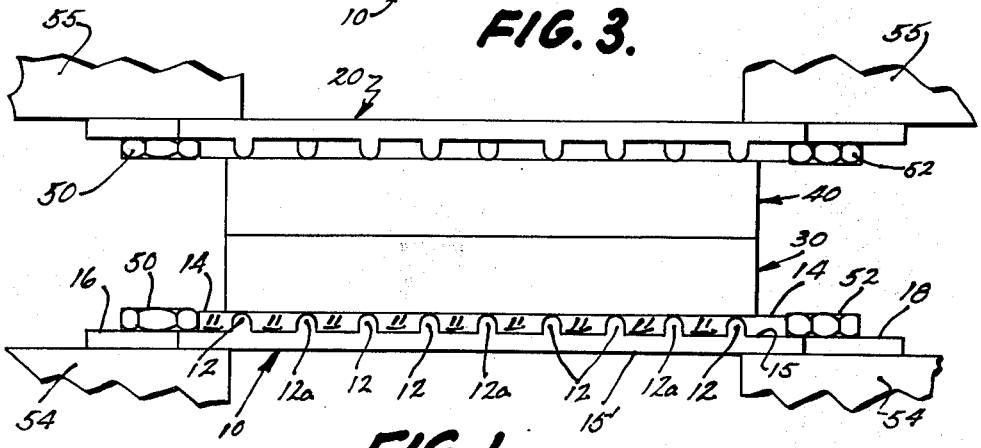
FIG. 1 is a fragmentary end view of the sandwich structure comprising a core box and a pair of mounting plates therefor secured to a shell core machine.

The lower core box mounting plate 10 is made, in the preferred embodiment, of a high thermal conductivity material such as aluminum which can be cast in the desired configuration shown. The mounting plate is substantially rectangular with an upper surface 15 and a lower surface 15'. A plurality of integral ribs 12 extend outwardly from surface 15 parallel and spaced from one another to define channels 11 therebetween (FIG. 1). The ribs 12 have rounded upper ends and extend from one edge of the rectangular mounting plate and terminate in an integral ridge 14 (FIG. 2) extending along an opposite edge and orthogonal to the ribs 12. The height of ridge 14 is the same as the ribs such that when a core box is secured to the plate, as shown in FIGS. 2 and 3, with its edge flush with the ridge edge of the plate, the channels 11 are closed at this end. At least two ribs 12a do not extend the full width of the plate, as best seen in FIGS. 2 and 3, and thus, leave flat surfaces 13 beyond the ends of such ribs forming lands such that spacer blocks (not shown) can be suitably mounted to one of the plates to extend between lands 13 of the pair of plates when the shell core machine sandwiches the structure as shown in FIG. 1. Such structure equalizes the forces on the plates so they will not tilt during the molding process. With large core boxes which cover a substantial portion of the mounting plates, spacers are not needed.

Each of the mounting plates includes flanges 16 and 18 with slots 17 and 19, respectively, for receiving bolts 50 and 51 (FIG. 1) which are utilized for securing the mounting plates to the mounting structure 54, 55 of a shell core machine. One of the mounting structures of the shell core machine is stationary to hold one of the plates stationary. The remaining mounting structure is coupled to a cylinder to permit the shell core halves to be opened and closed during a cycle of operation. Typically, the mounting structures 54, 55 do not cover the mounting plates 20, 30 such that the gas heating flame associated with the shell core machine can directly heat the mounting plates. Also, the plates are inverted in the machine with the end shown in FIG. 1 facing downwardly.

The core box is made of halves 30 and 40. Each half shown in the representative core box shown includes mold cavities 32 and 34 (FIGS. 2 and 3) of desired configuration for the core being molded. Each of the mold cavities includes a recess 36 in the floor thereof and a plurality of vents 38 extending through the core box. The mounting plates 10 and 20 include suitable apertures (not shown) such that the core boxes with threaded apertures can be bolted to the mounting plates with the vents 38 positioned in alignment over some of the channels 11 between ribs 12 and 12*a*. Also communicating with the core mold cavities are a plurality of injection ports 35 into which is injected during operation a resin-coated sand commercially available and in common use. Each of the core boxes includes a pair of alignment apertures and guide pins 37 and 33, respectively, which mate with the adjacent core box half when the unit is in the mold closed position as shown in FIG. 1.

The relatively large channels 11, open at one end and restricted at the opposite end, permit gas and air and particulate material to escape from the open channel ends. The spacer blocks, if employed, are configurated so as not to interfere with these channels or passageways. The ribs 12 provide significant contact with the core boxes such that flames from the gas furnace directed on the external surfaces 15' of the core box mounting plates transmit sufficient heat to the core box for setting the molding material.

Such construction, including the utilization of cast aluminum plates, greatly increases the efficiency of the core molding operation inasmuch as the core box vents do not become clogged as easily and need less maintenance. Also, the aluminum core plates themselves are less costly, lighter and easier to handle and heat transfer from the furnace to the core box is efficient.

It will become apparent to those skilled in the art that various modifications to the present invention can be made. Thus, for example, the ribs which have a generally semicircular upper surface, as shown in the preferred embodiment, can be modified in cross-sectional configuration. Also, various materials of relatively high thermal conductivity can be used for the mounting plates. In some embodiments, ridge 14 can be eliminated. Further, the ribs need not be in parallel relationship as long as channels defined between the ribs permit the ready escape of the air and gases and particulate material. These and other modifications to the present invention will, however, become apparent to one skilled in the art and will fall within the spirit and scope of the present invention as defined by the appended claims.

The embodiments of the invention in which an exclusive property or privilege is claimed are defined as follows.

1. In a shell core machine, a pair of core box mounting plates, each of which comprises:

a plate including a plurality of spaced ribs extending from a surface thereof to define exhaust channels therebetween; and means for mounting said plate to the shell core machine.

2. The plate as defined in claim 1 wherein said ribs extend in parallel relationship to one another and terminate at a ridge commonly coupled to said ribs and extending orthogonally with respect to said ribs, said ridge extending along one edge of said plate.

3. The plate as defined in claim 2 wherein said mounting means comprises a pair of integral flanges extending from opposite ends of said plate, each flange including a slot for receiving a mounting bolt.

4. The plate as defined in claim 3 wherein said plate is cast of aluminum.

5. The plate as defined in claim 4 wherein at least two spaced ribs do not extend the full width of said plate to define a flat surface beyond the end of each such rib.

6. In a shell core machine a mounting plate for mounting a core box half to a shell core machine wherein said plate comprises:

a generally rectangular member having a plurality of integral spaced ribs extending from one surface of said member and substantially across said member to define channels between said ribs; and an integrally formed ridge extending from said one surface and extending along an end of said ribs to enclose said channels at said end.

7. The mounting plate as defined in claim 6 wherein said ribs are in parallel relationship to one another and said ridge extends orthogonally to said ribs and at the same height as said ribs.

8. The plate as defined in claim 7 wherein said member includes integral flanges extending from opposite ends of said plate for securing said mounting plate to the shell core machine.

9. The plate as defined in claim 8 wherein said plate is cast of aluminum.

10. The plate as defined in claim 6 wherein at least two ribs are shorter than the remaining ribs to provide a flat surface beyond each end thereof.

* * * * *